US009428959B2

(12) United States Patent
Southard

(10) Patent No.: US 9,428,959 B2
(45) Date of Patent: Aug. 30, 2016

(54) DEVICE AND METHOD USABLE IN WELL DRILLING AND OTHER WELL OPERATIONS

(71) Applicant: Robert Charles Southard, Houston, TX (US)

(72) Inventor: Robert Charles Southard, Houston, TX (US)

( * ) Notice: Subject to any disclaimer, the term of this patent is extended or adjusted under 35 U.S.C. 154(b) by 694 days.

(21) Appl. No.: 13/694,285

(22) Filed: Nov. 15, 2012

(65) Prior Publication Data

US 2014/0131107 A1 May 15, 2014

(51) Int. Cl.

| | |
|---|---|
| ***E21B 4/00*** | (2006.01) |
| ***E21B 7/00*** | (2006.01) |
| ***E21B 10/26*** | (2006.01) |
| ***E21B 17/18*** | (2006.01) |

(52) U.S. Cl.

CPC ..... *E21B 4/006* (2013.01); *E21B 7/002* (2013.01); *E21B 10/26* (2013.01); *E21B 17/18* (2013.01)

(58) Field of Classification Search

CPC ..... E21B 4/006; E21B 7/002

See application file for complete search history.

(56) References Cited

U.S. PATENT DOCUMENTS

| | | | | |
|---|---|---|---|---|
| 2,528,300 | A * | 10/1950 | Degner | 175/377 |
| 2,643,860 | A * | 6/1953 | Koch | 175/99 |
| 3,375,889 | A * | 4/1968 | Demo | 175/106 |
| 5,845,721 | A * | 12/1998 | Southard | 175/57 |
| 6,378,626 | B1 * | 4/2002 | Wallace | 175/19 |
| 7,607,496 | B2 * | 10/2009 | Southard | 175/57 |

* cited by examiner

*Primary Examiner* — Giovanna C Wright

(57) ABSTRACT

Systems and methods usable for drilling wells and performing other well operations include a drilling tool having inner and outer, counter-rotating drill bits. Opposing reactive torques generated by the inner bit and the outer bit can reduce or cancel the net reactive torque transmitted upwell, through the drill string. Counter rotation of the inner and the outer drill bits can be achieved by a gear system, which transfers torque from a single rotating tubular shaft to a tubular sleeve positioned concentrically about the tubular shaft. The gear system transfers torque from a first gear to a second gear, at a one-to-one rotation/torque ratio, but with an opposite direction of rotation. Tools connected to the tubular sleeve and tubular shaft can thereby be provided with opposing rotational motion.

17 Claims, 5 Drawing Sheets

DEVICE AND METHOD USABLE IN WELL DRILLING AND OTHER WELL OPERATIONS

FIELD

Embodiments usable within the scope of the present disclosure relate, generally, to devices and methods usable to drill a well, and more particularly, but not by way of limitation, to devices for eliminating net reactive torque during well drilling, transmission systems usable in well drilling or other operations, and methods of transmitting torque usable in well drilling or other well operations.

BACKGROUND

In the quest for oil and gas, operators are continually searching for devices and methods for drilling wells faster and more economically. Traditionally, a drill bit is attached to a drill string, which is rotated to cause the drill bit to rotate, and hence, bore through the earth to drill a well. Over the years, various types of drill bits and drill strings have been developed to facilitate the formation of inclined and/or directional well bores.

Drilling into rock or other types of hard formations requires relatively large power levels and forces that are usually provided, at the drilling rig, by applying a torque and an axial force through a drill string to a drill bit. When drilling a vertical wellbore, for example, the lower portion of the drill string (e.g., the bottom hole assembly (BHA)), typically includes (from the bottom up) the drill bit, a bit sub, one or more stabilizers and/or drill collars, heavy-weight drill pipe, jarring devices, and crossovers for various thread forms. The BHA provides force, the measure of which is referred to as "weight-on-bit," to penetrate through rock or other hard materials.

Directional drilling operations require directional control to position the drill bit, and thus the well, along a particular trajectory in a formation. Directional control has traditionally been accomplished using special BHA configurations, instruments to measure the path of the wellbore in three-dimensional space, data links to communicate measurements taken downhole to the surface, mud motors, rotary steerable systems, and other specialized BHA components and drill bits adapted for this purpose. Conventionally, a directional driller can also use drilling parameters, such as weight-on-bit and rotary speed, and drilling tools to attempt to deflect the bit away from the current axis and/or trajectory and onto the desired path.

A typical directional drill string may contain a BHA which includes: a bit, a bent sub, a drilling motor, and one or more measurement-while-drilling, surveying, and/or logging tools. When using this type of BHA, the drill string is ideally held stationary with respect to rotation. The drilling motor generates rotation of the bit via circulation of the drilling fluid through the drilling motor. While the drill string is held stationary with respect to rotation, the well builds or reduces angle in a controlled manner as a function of the degree of bend in the bent sub.

Directional control can theoretically be accomplished through the use of a bent sub located near the bit, in which the bend within the sub orients the bit toward a direction that deviates from the axis of the wellbore when the drill string is not rotating. By pumping mud through the mud motor, the bit rotates, even when the drill string itself does not, allowing the bit alone to rotate and drill toward the direction of the bend in the bent sub. When a desired wellbore direction is achieved, the new direction may be maintained by permitting the drill string, including the bent section, to rotate, such that the drill bit bores in a generally straight direction, parallel to the current axis of the wellbore. As it is well known by those skilled in the art, however, a drill bit rotated by a mud motor has a tendency to stray from its intended drilling direction—a phenomenon known as "drill bit walk." Drill bit walk results from the cutting action, gravity, and rotation of the drill bit, as well as irregularities within the formation being drilled. It is desirable to eliminate, or at least minimize, drill bit walk to ensure drilling proceeds in the desired direction, thereby producing less tortuous well paths and improving drilling operation efficiency and success.

Drill bit walk, a common problem encountered when using directional drilling assemblies, is the result of the reactive torque generated by the bit. The bit torque generates an equal and opposite reactive torque that is transferred from the motor into the bottom hole assembly and drill string, causing the BHA and string to counter-rotate relative to the bit. Further, the reactive torque, and hence the drill string counter-rotation, can vary due to drilling conditions, such as the weight-on-bit, properties of the formation being drilled, and hole condition, all of which vary independently of each other. Because the bent sub is part of the BHA being counter-rotated, the direction, in which the well is being drilled, changes concurrent with changes in reactive torque, resulting in the drill bit walk phenomenon described above.

As a result of reactive torque induced drill bit walk, a driller is typically required to make numerous surface adjustments of the drill string, and hence the bent sub, to maintain a desired drilling direction. These numerous adjustments are subject to error, cost valuable rig time, and reduce the efficiency of the drilling operation. Additionally, directional drillers may attempt to employ measurement while drilling and rotary steerable systems to periodically correct deviations caused by drill bit walk, each of which adds expense and complexity to the downhole assembly, thus raising the cost of the drilling operation and increasing the possibility of a downhole equipment failure. By eliminating, or greatly reducing, the net reactive torque on the BHA and drill string, drilling can proceed unabated in the desired direction, saving time and expense. When drillers are able to eliminate, or reduce, net reactive torque on the BHA and drill string, they become able to use more powerful motors and more weight-on-bit to increase drilling rates of penetration and can create smoother, less tortuous boreholes for running logging tools and setting casing.

Some existing drilling devices incorporate an inner drill bit used to bore through a formation and an outer drill bit or a reamer used to smooth and/or enlarge the initial borehole. However, due in part to the differing diameters of such components, the rotational speed of each drill bit or reamer is different, which causes the drilling penetration rates of each bit or reamer to differ, creating unstable drilling progress as one bit drills ahead of the other, and reduces the overall rate of penetration of the drill due to the slower turning bit or reamer. Additionally, existing pilot-reamer systems contain bits which drill in the same direction, thereby transmitting a net reactive torque to the drill string during operations causing drill bit walk.

Therefore, there is a need for a drilling assembly that can be steered more quickly and accurately than conventional directional drilling assemblies.

In addition, there is a need for a device and methods usable to reduce the net reactive torque experienced by a BHA, mud motor, drill string and/or other components while drilling wells.

A need exits for a device and methods of use that will enable a faster and more efficient drilling of wells.

In addition, a need exists for a device that will transfer torque from the drilling motor to counter-rotating inner and outer drilling bits.

Further, there is a need for a device and method of use that will enable the counter-rotating of inner and outer bits, to be rotated at the same rotational speed. There is also a need for a device and methods of use that will enable the counter-rotating of inner and outer bits, to be rotated at different rotational speeds.

The present invention meets all of these needs.

SUMMARY

Embodiments usable within the scope of the present disclosure relate, generally, to systems and methods usable for performing operations on a well, eliminating net reactive torque on a bottom hole assembly and drill string during drilling and other operations, and/or transmitting torque that can be usable in drilling and other operations.

A specific embodiment includes an apparatus usable in well operations, such as drilling, that includes a rotatable cylindrical member (e.g., a shaft or tubular), a rotatable tubular member positioned concentrically about the rotatable cylindrical member, a first gear attached and/or otherwise engaged with the rotatable cylindrical member (e.g., directly or through intermediate members), a second gear attached to and/or otherwise engaged with the rotatable tubular member (e.g., directly or through intermediate members), and a third gear that engages the first and/or the second gear (e.g., directly or through intermediate members.) In an embodiment, the axis of rotation of the third gear can intersect that of the first and/or second gear.

In operation, one of the rotatable cylindrical members or the rotatable tubular members can be rotated, such as when drilling a well using a drill bit located at the downhole end of the rotatable cylindrical member or the rotatable tubular member. Rotation of the first member thereby rotates the associated first or second gear, which in turn causes rotation of the third gear, which in turn causes rotation of the other of the first or second gear, thereby causing rotation of the second member. As such, reactive torque can be reduced or eliminated, for example, by rotating the rotatable cylindrical member in a first direction (e.g., to rotate a drill bit associated therewith), while the described gear arrangement (e.g., a bevel gear arrangement) can cause rotation of the rotatable tubular member, e.g., in the opposite direction, thereby countering torque produced by rotation of the cylindrical member. The rotatable cylindrical member can include a fluid passageway therein, e.g., for transferring fluid to a drill bit and/or to and from adjacent components within a tubular string. In an embodiment, the gears and rotatable members can be sized and/or configured such that the rotatable cylindrical member and the rotatable tubular member rotate at equal rotational speeds, but in opposite directions. In a further embodiment, a second boring tool (e.g., a drill bit) can be associated with the rotatable tubular member, which can be used to further bore and/or expand the borehole created using a first boring tool associated with the rotatable cylindrical member.

In addition, embodiments usable within the scope of the present disclosure relate to apparatus for drilling wells that include a housing, a rotatable cylindrical member (e.g., a shaft or tubular) within the housing, a first tool (e.g., a drill bit) and a first gear attached to the rotatable cylindrical member, a second gear positioned concentrically about the rotatable cylindrical member, a second tool attached to the second gear, and a third gear that transfers torque from the first gear to the second gear. As described above, tools associated with the rotatable cylindrical member and/or second gear can include boring and/or drilling tools, e.g., having cutting elements thereon, and in an embodiment, the second tool can be positioned concentrically about the rotatable cylindrical member and/or the first tool.

Embodiments usable within the scope of the present disclosure further relate to a method for drilling wells that includes rotating a cylindrical member in a first direction, rotating a first gear attached to and/or otherwise associated with the cylindrical member, and transferring torque from the first gear to a second gear, thereby rotating the second gear. The second gear can be attached to and/or otherwise associated with a tubular member positioned concentrically about the cylindrical member, such that the tubular member is rotated in a direction opposite that of the cylindrical member. In an embodiment, transfer of torque between the first gear and the second gear can include rotation of a third gear (or any number of additional intermediate gears), the third gear having an axis of rotation different from that of the first and/or second gear. Rotating the cylindrical member in the first direction can generate a first reactive torque, while rotating the tubular member can generate a second reactive torque in the opposite direction, thereby at least partially countering the first reactive torque. As described above, boring tools and/or similar apparatus can be associated with the cylindrical and/or tubular members, such that rotation thereof can be used to drill a well and/or perform other operations.

Embodiments usable within the scope of the present disclosure can relate to methods for drilling wells that include rotating a first drill bit in a first direction about an axis of rotation, at a first rate of rotation, and rotating a second drill bit in a second direction about the axis of rotation, at a rate of rotation equal to that of the first drill bit. In an embodiment, the second drill bit can rotate in a direction opposite that of the first drill bit. The second drill bit can be positioned such that a bore with a diameter can be created using the first bit, and the diameter can be expanded using the second bit. As described above, torque can be transferred between the first and second drill bit, e.g., via a drive shaft used to rotate the first drill bit. In a further embodiment, fluid can be communicated from an internal portion of the first drill bit to an external surface of the first and/or the second drill bit, e.g., through one or more fluid ports located in the first drill bit.

Embodiments usable within the scope of the present disclosure also relate to apparatus for drilling wells that include a first drill bit and a second drill bit rotatable about an axis of rotation, in which the first drill bit and second drill bit are rotatable in opposite directions, in which the first and second drill bits are rotatable at the same rate of rotation, and in which the first and second drill bits are positioned downwell of a motor.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Figure 1:
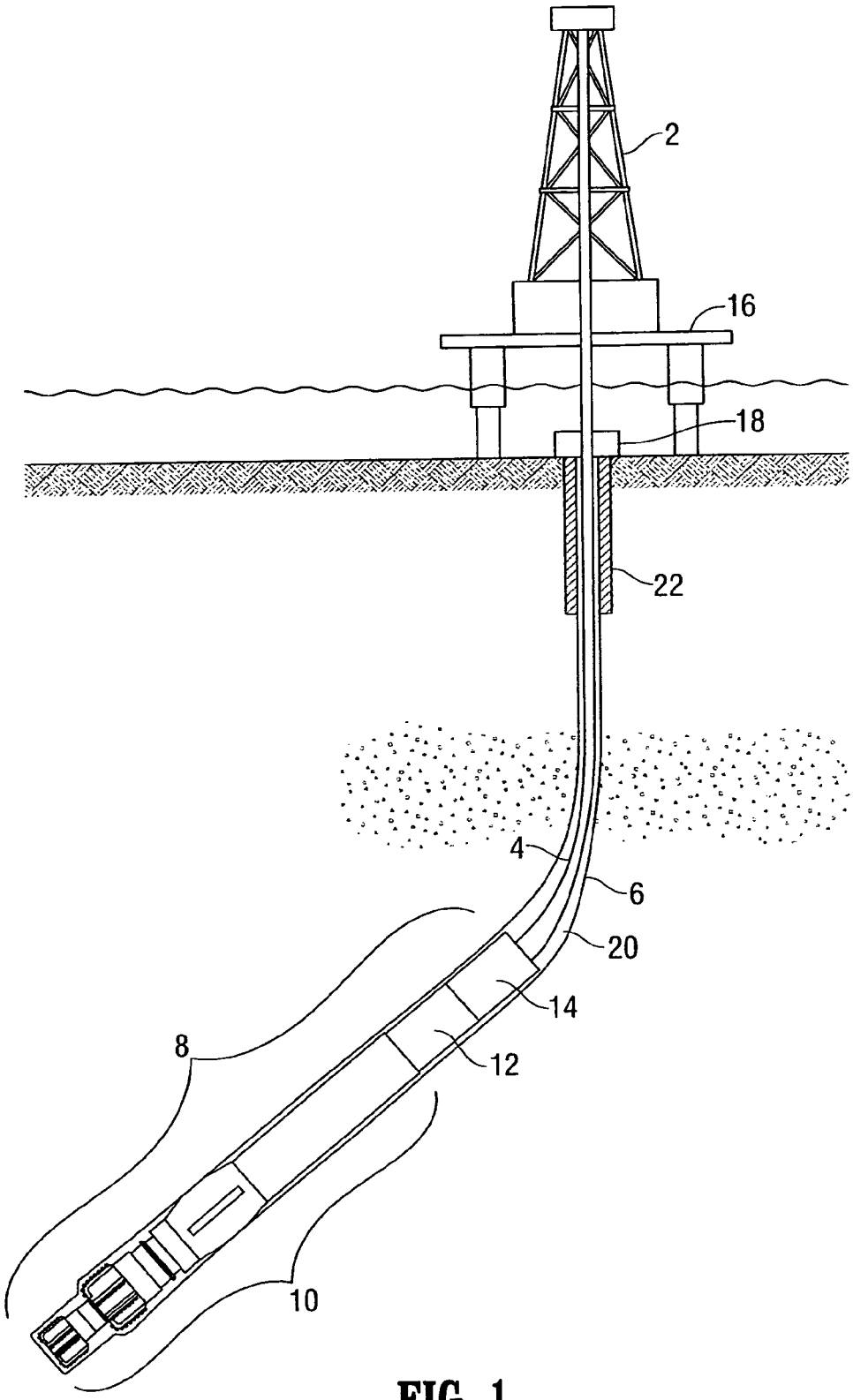
FIG. 1 depicts a conceptual view of a drilling rig, a wellbore, a drill string, and an embodiment of the device usable within the scope of the present disclosure.

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention. It should also be noted that like numbers appearing throughout the various embodiments and/or figures represent like components.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Embodiments within the scope of the present disclosure relate, generally, to systems and methods usable for drilling a well. The disclosed embodiments further relate to systems and methods usable in directional drilling, wherein the drilling sub includes two counter-rotating drill bits (e.g., an inner drill bit and an outer drill bit). Counter-rotation of the inner and the outer drill bits can be achieved by a transmission assembly, which transfers torque from a rotating tubular shaft (e.g. rotatable cylindrical member) to a tubular sleeve (e.g. rotatable tubular member) located concentrically about the tubular shaft. The opposing reactive torques generated by the inner bit and the outer bit can reduce or eliminate the net reactive torque transmitted upwell, through the drill string. The embodied devices and methods can significantly reduce the net reactive torque generated during drilling operations, thereby improving the ability to control the direction of the drilling and subsequently, the direction in which the well bore is extended. Matching the rate of rotation of each counter-rotating drill bit can allow for a greater rate of penetration and more uniform, steady drilling progress than drilling subs in which an outer bit or reamer rotates at a different rate than an inner bit.

Embodiments within the scope of the present disclosure further relate to systems and methods of transferring torque in a device usable in well drilling or other well operations. Specifically, the embodiments relate to systems and methods usable in transmitting torque from a rotating shaft (e.g. a shaft or rotatable cylindrical member connected to a drilling motor) to a sleeve or other rotatable tubular component located concentrically about or otherwise in association with the rotating shaft. A gear system can transfer torque from a first gear (e.g., engaged with a shaft connected to a drilling motor) to a second gear, at a one-to-one rotation/torque ratio; however, the second gear can rotate in the opposite direction from the first. Further, the second gear can be engaged with and/or connected to a tubular sleeve positioned concentrically around the rotating shaft, and the tubular sleeve can be connected to a tool. Accordingly, the resulting rotational motion of the tool is opposite to that of the rotating shaft. The rotating tool can be connected to another rotatable tool, such that both tools rotate in opposite directions, while torque is transmitted between the tools at a desired ratio, via the gears.

Referring now to FIG. 1, depicting a drilling rig (2) with a drill string (4) extending therefrom in a deviated well (6) is shown. As further depicted in FIG. 1, the drill string (4) can have a bottom hole assembly (8) associated therewith, which can include an embodiment of the present drilling device (10) positioned downhole from, and/or otherwise in association with, a drilling motor (12). The bottom hole assembly may also include a measurement while drilling device (14) and a bent sub (not shown), and stabilizers (not shown). FIG. 1 also depicts a blow-out-preventer (18), well casing (22), and an annulus area (20) formed between the drill string and the well. As is well understood by those of ordinary skill in the art, the drilling rig may be situated on a platform (16) that can be positioned on or connected to the ocean floor, although it should be understood that embodiments usable within the scope of the present disclosure can be used with any type of well and during any type of well operation, independent of the location of the well or the type of rig or platform used.

Figure 2:
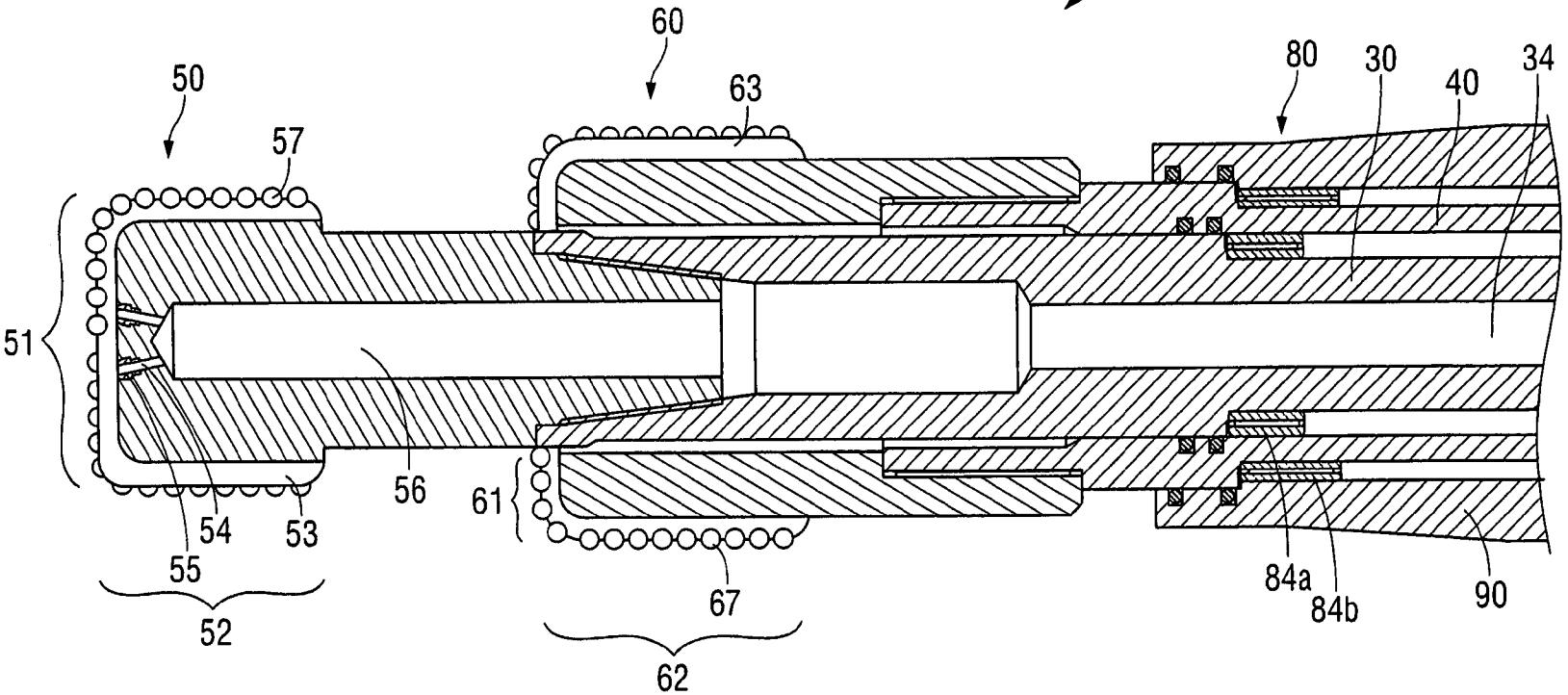
FIG. 2 depicts a partial cross sectional side view of an embodiment of the device usable within the scope of the present disclosure, which includes the inner and the outer drill bits.
Figure 3A:
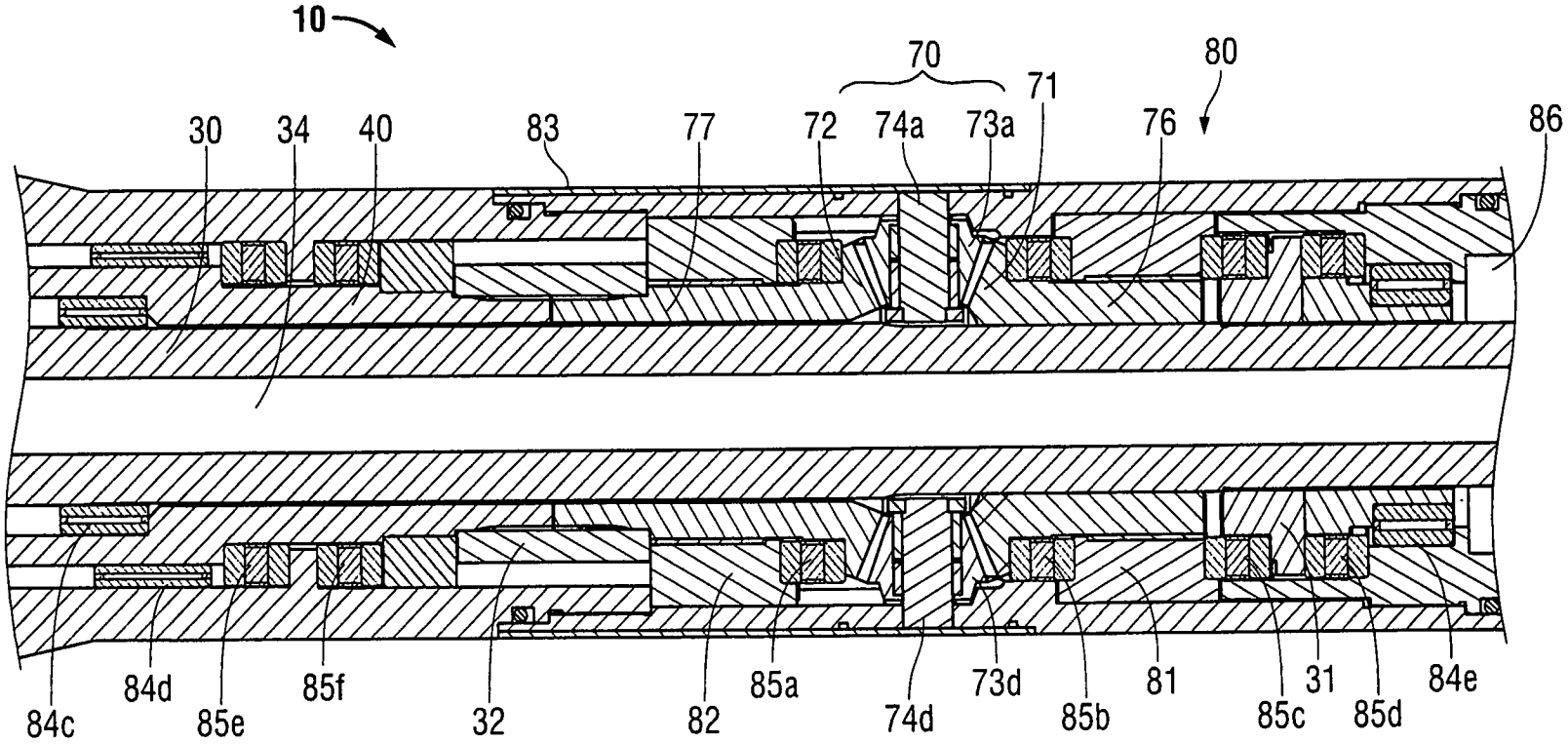
FIG. 3A depicts a partial cross sectional side view of an embodiment of the device usable within the scope of the present disclosure, which includes an embodiment of the gear system.

Referring now to FIGS. 2 and 3*a*, a sectional view of an embodiment of the drilling device (10) is shown. The depicted drilling device (10) includes a rotatable cylindrical member (30), which is shown in the depicted embodiment as a drive shaft (30), being generally elongated and having a generally cylindrical shape and an axial bore adapted for flowing fluid (e.g., drilling fluid) through the device. The device further includes a rotatable tubular member, shown as a drive sleeve (40), having a generally tubular shape and being concentrically disposed about the drive shaft (30). The depicted embodiment also contains an inner drill bit (50), an outer drill bit (60), a gear system (70) operatively connecting the drive shaft (30) and the drive sleeve (40), and a housing (80), which covers the internal components of the drill assembly, except for the inner and outer drill bits (50, 60).

As described above and further depicted in FIGS. 2 and 4, the drive shaft (30) is shown as an elongated tubular member that is located parallel to the central axis of the drilling device (10), and the drive shaft (30) extends from and/or is otherwise engaged with the output shaft or flexible coupling section (33), of an associated motor (not shown) at its upwell end, and is engaged with the inner drill bit (50) at its downwell end. The drive shaft (30) includes an axial throughbore (34) that can be used to flow drilling fluid to the inner bit (50). It should be understood that in a different embodiment, the drive shaft (30) may not contain an axial throughbore (34).

The inner drill bit (50), shown in FIG. 2, can be of any type and can have any configuration known in the art, including, but not limited to, a tri-cone bit, a roller cone bit, or a polycrystalline diamond compact (PDC) bit. The inner bit (50) can comprise a plurality of orifices (54) for communicating drilling fluid between the internal cavity (56) and the exterior of the inner bit (50). In the depicted embodiment, the drive shaft (30) is connected to the inner bit (50), via a threaded box/pin connection, in which the drive shaft (30) has a female threaded section at an end thereof, while the inner drill bit includes a complementary male threaded section. It should be understood, however, that any manner of engagement can be used to connect the inner drill bit (50) with the drive shaft (30), including, without limitation, welding, crimping, use of set screws, pins, and/or similar fasteners, or combinations thereof. In another embodiment, the drive shaft (30) can be indirectly connected to the inner drill bit (50) by one or more intermediate segments of drill pipe or other tubular members.

Referring again to FIG. 4, at its upwell end, the drive shaft (30) can be attached to a drilling motor (not shown), located upwell from the drilling device (10). A typical drilling motor can convert the energy of pressurized drilling fluid to rotational force, or torque, which can be output through an output shaft. The drive shaft (30) can be attached to the output shaft or flexible coupling section (33) of a motor by using a threaded box/pin connection, a spline connection, or any other method of connection known in the art. For example, the drive shaft (30) can be welded to the output shaft or flexible coupling section (33) of a motor or integrally formed with the output shaft or flexible coupling section. In another embodiment, the drive shaft (30) may be indirectly connected to the output shaft or flexible coupling section (33) of a drilling motor by one or more intermediate segments of drill pipe or other tubular members.

Referring again to FIGS. 2 and 3A, the drive sleeve (40) is shown as a tubular member positioned concentrically about the drive shaft (30). At its downwell end, the drive sleeve (40) can be attached to an outer drill bit (60). Similar to the inner bit (50), the outer bit can be of any type and can have any configuration known in the art, but in a preferred embodiment, the outer drill bit (60) can include static cutting elements (67). The drive sleeve (40) can be directly or indirectly connected to the outer drill bit (60), for example, via one or more intermediate sleeves and/or connectors incorporated between the drive sleeve (40) and the outer drill bit (60). The manner in which the drive sleeve (40) is connected to the outer bit (60) can include any means known in the art, as previously described, allowing the transfer of torque between the two parts. For example, the drive sleeve (40), any intermediate sleeve, and the outer drill bit (60) can be engaged to one another using a threaded connection, by welding, by crimping, using a forced or interference fit, using one or more fasteners, using a spline connection, using a keyway and key connection, or by using any other means of attachment known in the art, which allow the transfer of torque between the parts.

Referring to FIG. 2, the figure depicts an embodiment of the inner and outer drill bits (50, 60). The inner drill bit (50) is shown having a PDC configuration and comprises a front bit surface (51) and a side bit surface (52). The front bit surface (51) is the primary area that contacts a formation during drilling. The surfaces of the inner drill bit (50) are shown having a plurality of cutter blades (53) arranged so that during rotation, the cutter blades bore into the formation. FIG. 3 depicts the inner drill bit (50) having fluid orifices (54) that terminate in nozzles (55) at the outer surface of the drill bit. The fluid passageways and nozzles transfer drilling fluid through the drilling device (10) to the outer surface of the drill bit, which will clean the inner drill bit (50) as well as the outer drill bit (60).

The outer drill bit (60) can be usable to drill and/or enlarge the outer diameter of the wellbore. FIG. 2 depicts the outer drill bit (60) located upwell from the inner drill bit (50) and having an outer diameter which is larger than the outer diameter of the inner drill bit (50). Thus, during drilling operations, both bits may cut through the formation at generally the same rate, with a generally equal amount of weight applied from the upwell direction. The outer drill bit (60) is shown concentrically positioned about the drive shaft (30) and includes an aperture though its axial center to accommodate the drive shaft (30). Similar to the inner drill bit (50), the outer drill bit (60) has a front bit surface (61) and a side bit surface (62), the front bit surface being the primary area of contact between the outer bit and the formation. Both surfaces (61, 62) of the outer drill bit include cutter blades (63), which can be oriented to rotate in an opposite direction relative to the cutter blades (53) on the inner drill bit (50). Although FIG. 2 depicts an embodiment of the drilling device (10) configured to rotate the inner bit (50) in a counterclockwise direction and the outer drill bit (60) in a clockwise direction, it should be understood that in a different embodiment, the drilling device (10) can be configured to rotate the inner drill bit (50) in the clockwise direction and the outer drill bit (60) in the counterclockwise direction.

Each cutter blade (53, 63) is shown having cutting elements (57, 67) associated therewith, with each cutting face containing cutting material, such as a polycrystalline diamond compact (PDC). The number of cutter blades (53, 63) located on the external surfaces (51, 52, 61, 62) of the inner and outer drill bits (50, 60) can vary depending on variables and conditions, such as formation hardness, size of the wellbore, desired penetration rate, hole angle, pressure, temperature, other conditions and variables and combinations thereof.

The embodiment depicted in FIG. 2 shows the drilling device (10) housing (80). Specifically, FIG. 2 depicts the downwell portion of the housing (80) having a plurality of seals, preventing drilling fluid from entering and contaminating the internal components. The housing (80) can include a stabilizer (90), which keeps the drilling device (10) centered, preventing or reducing unwanted deviations from the desired drilling direction. Stabilizers are well known by those skilled in the art and can be of any type and can have any configuration.

Figure 3B:
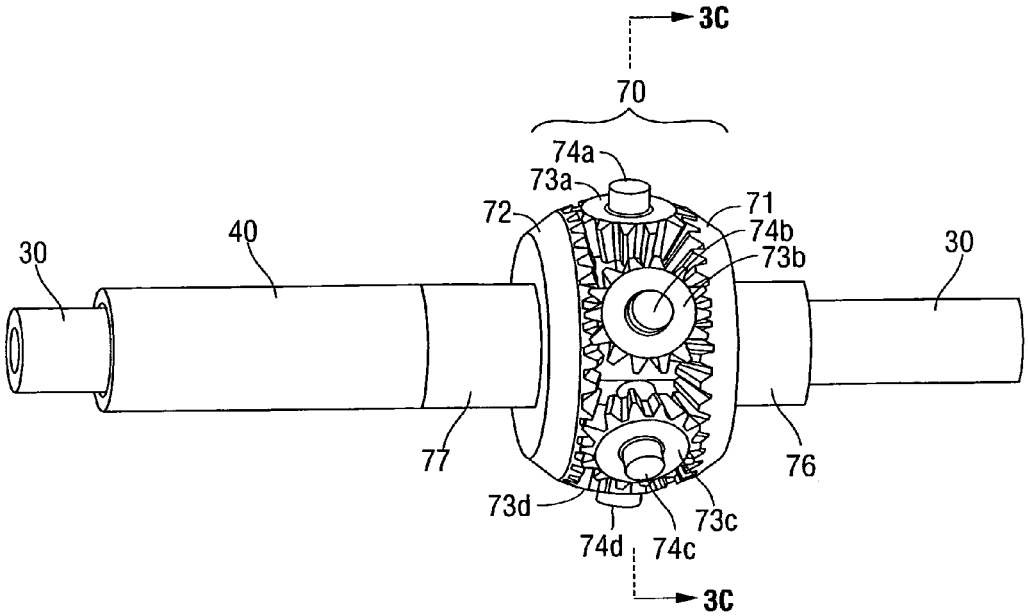
FIG. 3B depicts a partial isometric view of an embodiment of the device usable within the scope of the present disclosure, which includes an embodiment of the gear system.
Figure 3C:
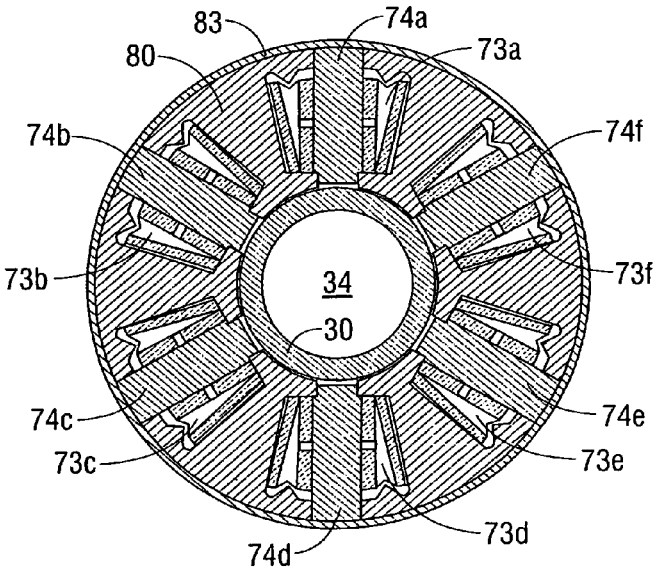
FIG. 3C depicts a partial cross sectional side view of an embodiment of the device usable within the scope of the present disclosure, which includes an embodiment of the gear system.

Referring now to FIGS. 3A, 3B, and 3C, the figures depict a close-up view and a sectional view, respectively, of the gear system (70) enclosed within the drilling device housing (80), shown in FIG. 3A, but omitted from FIG. 3B for clarity. The gear system (70) operatively connects the drive shaft (30) and the drive sleeve (40), transferring torque from the drive shaft (30) to the drive sleeve (40). The depicted gear system (70) comprises a first gear (71), a second gear (72), and six intermediate pinion gears (73*a-f*). The pinion gears can engage the first and second gears (71, 72). The first and second gears (71, 72) are longitudinally spaced along the same axis of rotation with the apex surface of each gear facing the other. As shown, the six pinion gears (73*a-f*) are positioned in engaging contact between the first and second gears (71, 72), in an equally spaced circular arrangement. A support pin (74*a-f*) can intersect each pinion gear (73*a-f*) through its axis, enabling the pinion gears to rotate about respective pins (74*a-f*), while preventing any lateral movement along the axis of rotation. Each support pin (74*a-f*) can be retained in place by the housing (80), which further prevents the pinion gears (73*a-f*) from moving linearly along their axis of rotation. Although six pinion gears are depicted in the current embodiment, it should be understood that any number of pinion gears can be incorporated into the gear system (70) without departing from the scope of the present disclosure.

Continuing with reference to FIGS. 3A and 3B, near or at the axial center of the drilling device (10), the first gear (71) is positioned concentrically about the drive shaft (30), such that the axis of the first gear and the central axis of the drive shaft (30) coincide. The first gear (71) can be connected to the drive shaft (30) by welding the two components together. Although the present embodiment depicts welding as the means of attaching the first gear (71) to the drive shaft (30), the first gear (71) and drive shaft (30) can be connected with one another using any method known in the art to prevent relative rotation and allowing the transfer of torque between the two components, including, but not limited to, welding, crimping, threading, matching splines, and/or keys/locating pins. As depicted in FIG. 3A, the first gear (71) may comprise an extended hub (76), which may increase the area of connection between the first gear (71) and the drive shaft (30). In another embodiment, the first gear (71) can be integrally formed with the drive shaft (30).

FIGS. 3A and 3B also depict the second gear (72) positioned concentrically about the drive shaft (30) and connected to the drive sleeve (40). The depicted relative positioning of the two components is such that the axis of rotation of the second gear (72) and the longitudinal axis of the drive sleeve (40) coincide. The second gear (72) may be connected to the drive sleeve (40) using any method known in the art, including all methods described previously, which prevent relative rotation and allow the transfer of torque between the two components. As depicted in FIG. 3A, the second gear (72) may comprise an extended hub, which then connects to the drive sleeve (40) via any of the methods previously described. In another embodiment, the second gear (72) may be integrally formed with the drive sleeve (40), or the extended hub (77) may be sufficiently long to function as the drive sleeve (40), thereby becoming the drive sleeve (40).

Figure 4:
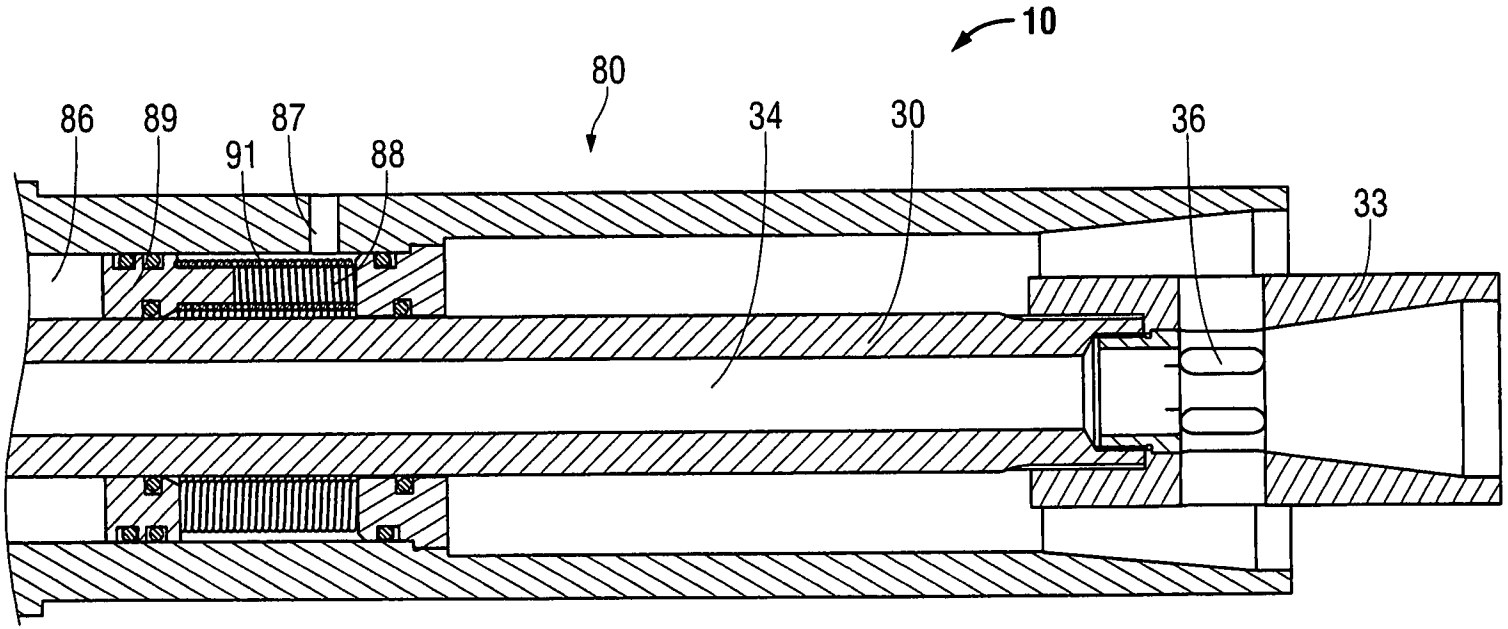
FIG. 4 depicts a partial cross sectional side view of an embodiment of the device usable within the scope of the present disclosure, which includes a motor connection.

Although the embodiments depicted in FIGS. 2-4 relate to a device (10) having a gear system (70) that incorporates straight bevel gears, other gear systems, which incorporate spiral bevel gears, Zerol® gears, hypoid bevel gears, multi-stage planetary gears, compound planetary gears, miter gears, or other types of gears known in the art, can be used. Furthermore, in various embodiments, the first and second gears (71, 72) can be replaced by crown gears, with the pinion gears (73*a-f*) being bevel gears and/or spur gears, or replaced by stepped pinion gears.

FIGS. 2 and 3A depict the drilling device housing (80), which is shown enclosing the gear system and bearing components, isolating them from drilling fluid and the rock particles in the annulus area (20), shown in FIG. 1. The housing (80) and a series of bearings (84*a-e*, 85*a-f*), whether ball, roller, or any other type known in the industry, can maintain relative structural integrity between the drive shaft (30), the drive sleeve (40), and all components of the gear system (70), facilitating the function of the gear system. Furthermore, as counter forces are introduced into the outer drill bit (60) during drilling operations, roller bearings (85*a-f*) allow the transfer of these counter forces through the various rotating and static components of the drilling apparatus (10), while providing sufficient structural support for the components to prevent excessive concentrations of forces, thereby averting damage.

To further facilitate functionality of the drilling device (10), all moving components can be lubricated and maintained in a proper structural and/or spatial relationship during drilling operations. The rigid structure of the housing (80) and bearings (84*a-e*, 85*a-f*) can maintain the position of each of the above-described components during drilling operations. As the outer drill bit (60) applies force to the formation, an opposite counter force can be created and transferred through the outer drill bit (60), the drive sleeve (40), intermediate sleeves (not shown), and into the gear system (70). The housing (80) and bearings (84*a-e*, 85*a-f*) can provide sufficient structural support to the gear system (70) to prevent deformation of the gears or movement of the gears from their proper position, caused by the counter force. To facilitate this function, a first support ring (31) can be attached to the drive shaft (30). As depicted in FIG. 3A, the first support ring (31) can be a sturdy ring member attached to the drive shaft (30), upwell from the gear system (70). As the counter force is transferred from the outer drill bit (60), the first support ring (31) can prevent the drive sleeve (40) and the gear system (70) from moving upwell along the drive shaft (30). The first support ring (31) may be attached to the drive shaft (30) by any means known in the art, including, but not limited to, welding, crimping, threading, matching of splines, and/or the use of keys and locating pins, which are all usable to prevent relative axial movement between the two components (31 and 30). In another embodiment, the first support ring (31) can be integrally formed with the drive shaft (30). In still another embodiment, the first support ring (31) can be unattached to the drive shaft, and further used to transmit the counter force to the housing (80). The housing (80), in turn, may abut the mud motor (not shown) located upwell of the drilling device (10), which absorbs a large portion or all of the counter force from the outer drill bit (60).

As the drive shaft (30) and the drive sleeve (40) rotate in opposite directions, the housing (80) can remain static. As mentioned above, to enable the relative rotation between the drive sleeve (40) and the drive shaft (30), while maintaining structural integrity of the device, the housing (80) can include a plurality of bearings (84*a-e*, 85*a-f*) located between the internal components, within the housing (80), in a manner that permits relative movement. Referring to the embodiment depicted in FIGS. 3A, 3B, and 3C, at the center of the gear system (70) are six pinion gears (73*a-f*) rotating about support pins (74*a-f*). The distal ends of the support pins (74*a-f*) are retained in the housing (80) and enclosed by a cover (83). Further abutting the first and second gears (71, 72) are first and second spacer rings (81, 82), which are encompassed by the housing (80). The first spacer ring (81) can be placed between the first gear (71) and the first support ring (31), while the second spacer ring (82) can be placed between the second gear (72) and a second support ring (32), which may connect the drive sleeve (40) and the extended hub (77) and/or transfer the counter force from the drive sleeve (40) to the second space ring (82). On each side of the first spacer ring (81) is a roller bearing (85*c*, 85*d*), which allows the reactive force from the outer drill bit (50) to be further transferred from the first spacer ring (81), to the first support ring (31), and to the housing (80), while the first and second gears (71, 72) are rotating. It should be understood that while the embodiment of the drilling device depicted in FIG. 3A discloses a plurality of support rings (31, 32), spacer rings (81, 82) and roller bearings (85*a-f*), other embodiments of the drilling device may not include these support components or may include these components (or functionally-similar components, such as other types of bearings) in various numbers and locations. For example, the gear system (70), the drive sleeve (40), and the drive shaft (30) can be adapted to support all forces generated in the course of drilling operations, without the need to transfer these forces to the housing.

Embodiments, shown in FIGS. 3A and 4, include a lubrication system (86) associated with the drilling device (10), which is shown as a self-contained system, such that the lubricating fluid, which surrounds the gear system (70) and the bearings (84*a-e*, 85*a-f*), can be contained and sealed within a plurality of slots, located inside the housing. A plurality of static and rotating seals, can be used to seal and isolate the lubricating fluid from the drilling fluid. This allows the gear system (70) and bearings (84*a-e*, 85*a-f*) to be lubricated by high-quality, particulate-free lubricants, rather than drilling mud, and permits the utilization of a higher precision gear system with tighter tolerances, which improves the life and reliability of the transmission system.

In order to prevent contaminants from entering the lubrication system (86), the drilling device (10) can incorporate a pressure equalization system, wherein the static fluid pressure in the annulus (20, see FIG. 1) is introduced into the lubrication system (86), without any fluid exchange. As the static pressure in the annulus increases with depth, the increasing pressure is introduced into a pressure chamber (88), formed between the housing (80) and the drive shaft (30), through a vent (87) in the housing (80). The pressure chamber (88) and the lubrication system (86) can be isolated from one another by a sliding piston (89), located around the drive shaft (30), having one or more sealing elements thereon and, thus, fluidly isolating the pressure chamber (88) from the lubrication system (86). The increasing pressure within the pressure chamber (88) can create a positive force, which can press against the sliding piston (89), increasing the pressure in the lubrication system (86). When the internal pressure of the lubrication system (86) is equalized with the fluid pressure in the annulus (20), the external drilling fluid cannot be forced past the plurality of seals between the housing and/or internal components of the drilling tool (10) and into the lubrication system (86). In another embodiment, the sliding piston (89) may be acted upon by one or more springs (91) or a similar biasing member, which may act alone or in conjunction with the positive force generated by fluid pressure within the pressure chamber (88). Such a configuration can result in a lubrication system (86) having a greater internal pressure than the fluid pressure located within the annulus (20), adjacent to the drilling device (10).

As previously explained, embodiments usable within the scope of the present disclosure can relate to systems and methods of transferring torque, which can be usable in the course of well drilling or other well operations. Specifically, the depicted and disclosed embodiments relate to transmission systems usable to transfer torque from a rotating shaft, such as a shaft connected to a drilling motor, to a tubular member located concentrically about the rotating shaft.

As depicted in FIGS. 2, 3A, and 4, the drive shaft (30), the drive sleeve (40), and the gear system (70), can form a torque transmission system that can be usable in well drilling or other well operations. While the depicted embodiments are described in association with inner and outer drill bits (50, 60), the transmission may be used in various types of devices and/or circumstances to transfer torque from an output shaft or a flexible coupling (33) of a drill motor (not shown), to a drive sleeve (40), which in turn, may be connected to an outer drill bit (60), a reamer, or any other component requiring rotation. In another embodiment, the drive sleeve (40) may be excluded, and the outer drill bit (60), a reamer, or other component may be connected directly to the second gear (72) of the gear system (70).

In operation, the depicted drilling tool (10) diverts torque from a single rotating drive shaft (30), connected to an inner drill bit (50), and transfers torque to a counter-rotating outer drill bit (60). Torque can be generated by a drilling motor (not shown) located upwell from the drilling device (10). Any drilling motor known in the art, especially motors used in directional drilling, may be used with the disclosed drilling device. As the drilling motor receives high pressure drilling fluid, it imparts torque to an output shaft or a flexible coupling (35), which is connected to drive shaft (30).

As the drive shaft (30) rotates, the attached inner drill bit (50) rotates in the same direction as the drive shaft (30). Simultaneously, the gear system (70) transfers torque from the drive shaft (30) to the drive sleeve (40), causing the outer drill bit (60) to rotate at the same rate of rotation, but in an opposite direction relative to the inner drill bit (50). As the inner and the outer drill bits (50, 60) drill through the rock formation, the reactive torques, experienced by each drill bit, may be similar or equal in magnitude, but opposite in direction. Thus, the opposing torque forces can reduce or cancel one another. As a result, no net reactive torque is transmitted upwell of the drilling device (10). Although the drilling device (10) can be designed to cancel most or all net reactive torque, the formation and other variables may cause the magnitude of either torque to fluctuate, resulting in a net reactive torque being transmitted through the drill string. In such a scenario, however, the net reactive torque is still significantly less than the reactive torque generated by conventional drilling devices.

Referring again to FIGS. 2 and 4, as the inner and outer drill bits (50, 60) rotate, drilling fluid can be communicated through the drive shaft (30) to aid in the drilling process. As depicted, the drive shaft (30) contains an axial throughbore (34) that can be used to transfer drilling fluid into the inner cavity (56) of inner drill bit (50). Drilling fluid can be communicated from a source located upwell of the drilling device (10), into the drive shaft (30), and through a plurality of inlets (36), which can be located on the drive shaft (30), or a flexible coupling (33) that is downwell of the drilling motor (not shown). The drilling fluid flows through the axial throughbore (34) of the drive shaft (30), into the inner cavity (56), and exits through a plurality of orifices (54) extending from the internal cavity (56) to the exterior or side surfaces (51, 52) of the inner drill bit (50). Each orifice (54) can terminate with a nozzle (55) at the surfaces (51, 52) of the inner drill bit (50). The drilling fluid aids in cleaning the inner drill bit surfaces (51, 50) as well as lifting cuttings. As the drilling fluid flows upwell, the drilling fluid can aid in cleaning the outer drill bit surfaces (61, 62) and can be used to lift cuttings upwell of the outer drill bit (60).

While various embodiments usable within the scope of the present disclosure have been described with emphasis, it should be understood that within the scope of the appended claims, the present invention can be practiced other than as specifically described herein.

What is claimed is:

1. An apparatus usable in well operations, the apparatus comprising:

a rotatable cylindrical member terminating in a first plane and attached to a first boring tool;

a rotatable drive shaft operatively connected to the first boring tool;

a rotatable tubular member positioned concentrically about the rotatable cylindrical member and terminating in a second plane, wherein the rotatable tubular member is attached to a second boring tool;

a first gear comprising an axis of rotation and attached to the rotatable cylindrical member;

a second gear comprising an axis of rotation and attached to the rotatable tubular member; and a third gear comprising an axis of rotation intersecting the axis of rotation of the first gear, the second gear, or both, wherein the third gear engages the first gear and the second gear.

2. The apparatus of claim 1, wherein the first gear and the second gear comprise a bevel gear configuration.

3. The apparatus of claim 1, wherein rotation of the rotatable cylindrical member imparts rotation to the rotatable tubular member.

4. The apparatus of claim 3, wherein rotation of the rotatable cylindrical member is imparted by a mud motor located upwell from the rotatable cylindrical member, and wherein a housing absorbs a portion of the force created by the rotation of the rotatable tubular member.

5. The method of claim 4, wherein the housing comprises at least one spacer ring and at least one support ring, and wherein the force created by the rotation of the rotatable tubular member and absorbed by the housing is transmitted through the spacer ring and the support ring.

6. The apparatus of claim 1, wherein the rotatable cylindrical member comprises a rotational speed equal to a rotational speed of the rotatable tubular member, and wherein the rotatable cylindrical member comprises a rotational direction opposite to a rotational direction of the rotatable tubular member.

7. The apparatus of claim 1, wherein the rotatable cylindrical member comprises a fluid passageway for transferring fluid.

8. The apparatus of claim 1, wherein the rotatable cylindrical member extends throughout the length of the apparatus.

9. An apparatus for drilling wells, the apparatus comprising:

a housing;

a rotatable cylindrical member within the housing;

a first tool operating in a first plane and attached to the rotatable cylindrical member;

a rotatable drive shaft operatively connected to the first tool;

a first gear comprising an axis of rotation and attached to the rotatable cylindrical member;

a second gear comprising an axis of rotation and positioned concentrically about the rotatable cylindrical member;

a second tool operating in a second plane and attached to the second gear; and a third gear that transfers torque from the first gear to the second gear, wherein the third gear comprises an axis of rotation that intersects the axis of rotation of the first gear, the axis of rotation of the second gear, or both.

10. The apparatus of claim 9, wherein the first tool is rotatable at a rotational speed equal to a rotational speed of the second tool, and wherein the first tool is rotatable in a direction opposite to a rotational direction of the second tool.

11. The apparatus of claim 9, wherein the first gear and the second gear comprise a bevel gear configuration.

12. The apparatus of claim 9, wherein the second tool is positioned concentrically about the rotatable cylindrical member, the first tool, or combinations thereof.

13. The apparatus of claim 9, wherein the first tool comprises a first cutting element and the second tool comprises a second cutting element.

14. The apparatus of claim 9, wherein the rotatable cylindrical member comprises a throughbore for transferring drilling fluid.

15. A method for drilling wells, the method comprising the steps of:

rotating a cylindrical member in a first direction, in a first plane;

rotating a first gear attached to the cylindrical member along an axis of rotation;

transferring torque from the first gear to a second gear along an axis of rotation, thereby rotating the second gear, wherein the second gear is attached to a tubular member positioned concentrically about the cylindrical member, and wherein the torque is transferred by rotating a third gear along an axis of rotation intersecting with the axis of rotation of the first gear, the second gear, or both; and rotating the tubular member in a second direction opposite the first direction, in a second plane above the first plane.

16. The method of claim 15, further comprising the steps of:

rotating a first boring tool attached to the cylindrical member in the first direction at a rotational speed; and rotating a second boring tool attached to the tubular member in the second direction and at a rotational speed equal to the rotational speed of the first drilling tool.

17. The method of claim 15, wherein rotating the cylindrical member generates a first reactive torque in a first direction, and wherein rotating the tubular member generates a second reactive torque in a second direction opposite the first direction.

* * * * *